US007699719B2

(12) United States Patent
Sugimoto

(10) Patent No.: US 7,699,719 B2
(45) Date of Patent: Apr. 20, 2010

(54) GOLF CLUB HEAD

(75) Inventor: Yasushi Sugimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 740 days.

(21) Appl. No.: 11/514,913

(22) Filed: Sep. 5, 2006

(65) Prior Publication Data

US 2007/0099727 A1 May 3, 2007

(30) Foreign Application Priority Data

Oct. 28, 2005 (JP) ..... 2005-314975

(51) Int. Cl.
*A63B 53/04* (2006.01)

(52) U.S. Cl. ..... 473/345; 473/349

(58) Field of Classification Search ..... 473/324–350, 473/287–292

See application file for complete search history.

(56) References Cited

U.S. PATENT DOCUMENTS 4,214,754 A * 7/1980 Zebelean ..... 473/346
4,429,879 A * 2/1984 Schmidt ..... 473/346
4,465,221 A * 8/1984 Schmidt ..... 228/125
5,294,037 A * 3/1994 Schmidt ..... 228/125
5,346,217 A * 9/1994 Tsuchiya et al. ..... 473/345
5,362,055 A * 11/1994 Rennie ..... 473/342
5,378,295 A * 1/1995 Yamashita et al. ..... 148/654
5,518,240 A * 5/1996 Igarashi ..... 473/345
5,665,014 A * 9/1997 Sanford et al. ..... 473/345
5,704,850 A * 1/1998 Shieh ..... 473/324
6,162,133 A * 12/2000 Peterson ..... 473/345
6,280,349 B1 * 8/2001 Cook ..... 473/345
6,381,828 B1 * 5/2002 Boyce et al. ..... 29/527.4
6,575,845 B2 * 6/2003 Galloway et al. ..... 473/329
6,663,504 B2 * 12/2003 Hocknell et al. ..... 473/329
6,676,536 B1 * 1/2004 Jacobson ..... 473/329
6,945,876 B2 * 9/2005 Nakahara et al. ..... 473/329
6,964,617 B2 * 11/2005 Williams ..... 473/245
6,969,326 B2 * 11/2005 De Shiell et al. ..... 473/345
7,128,662 B2 * 10/2006 Kumamoto ..... 473/345
7,182,699 B2 * 2/2007 Matsunaga ..... 473/345
7,303,487 B2 * 12/2007 Kumamoto ..... 473/345
7,371,191 B2 * 5/2008 Sugimoto ..... 473/345
7,396,297 B2 * 7/2008 Hirano ..... 473/345
7,431,664 B2 * 10/2008 Meyer et al. ..... 473/332
7,479,070 B2 * 1/2009 Hirano ..... 473/345
7,510,485 B2 * 3/2009 Yamamoto ..... 473/345

(Continued)

FOREIGN PATENT DOCUMENTS

JP 2003-250938 A 9/2003

*Primary Examiner*—Sebastiano Passaniti
(74) *Attorney, Agent, or Firm*—Birch, Stewart, Kolasch & Birch, LLP

(57) ABSTRACT

A golf club head comprises: a hollow main body provided with an upper opening located in a crown portion of the head; and a crown plate fitted in the upper opening and having a specific gravity less than that of the main body, wherein the main body is provided around the upper opening with a crown plate support supporting a peripheral edge part of the inner surface of the crown plate. The crown plate support has a width of not more than 5 mm. The minimum distance between the upper edge of the club face and the crown plate in the back-and-forth direction of the head is not less than 10 mm. The thickness of the crown plate is not more than 0.7 mm.

21 Claims, 9 Drawing Sheets

U.S. PATENT DOCUMENTS 7,601,078 B2 * 10/2009 Mergy et al. ..... 473/345
2001/0055995 A1 * 12/2001 Cackett et al. ..... 473/342
2004/0097300 A1 * 5/2004 Lu ..... 473/342
2004/0192468 A1 * 9/2004 Onoda et al. ..... 473/345
2004/0224790 A1 * 11/2004 Lu ..... 473/345
2007/0105656 A1 * 5/2007 Hirano ..... 473/345

* cited by examiner

GOLF CLUB HEAD

BACKGROUND OF THE INVENTION

The present invention relates to a golf club head, more particularly to a structure of the crown portion of a hollow head capable of lowering the center of gravity without deteriorating the durability of the crown portion.

Heretofore, a golf club head comprising a hollow main body having an opening in the crown portion and a lightweight crown plate covering the opening has been proposed as disclosed in JP-P2003-250938A. In this golf club head (a), as shown in FIG. 17, the hollow main body (b) is provided around the opening (O) with a support (f) for the crown plate (c) which support has a width (A) of about 10 mm in order to secure a durable junction between the hollow main body (b) and crown plate (c).

Thus, due to the crown plate support (f) having a relatively large width (A), the weight of the crown portion can not be fully reduced in spite of the lightweight crown plate, and as a result, maximal lowering of the center of gravity is not possible.

SUMMARY OF THE INVENTION

It is therefore, an object of the present invention to provide a golf club head, in which the crown plate support provided around the opening is minimized, without decreasing the durability of the junction of the crown plate and the main body, thus a further lowering of the center of gravity is possible.

Upon lowering the center of gravity of the head, the sweet spot shifts towards the sole portion of the head, and the probability of hitting a ball at a position on the upper side of the sweet spot SS becomes high. As a result, at impact, the club head makes a slight rotation (in FIG. 2, clockwise) around the center of gravity G and the ball is provided with a larger shot angle and a lower backspin due to the so called vertical gear effect. Therefore, the carry of the ball is increased.

According to one aspect of the present invention, a golf club head comprises: a hollow main body provided with an upper opening located in a crown portion of the head; and a crown plate fitted in the upper opening and having a specific gravity less than that of the main body, and the main body is provided around the upper opening with a crown plate support supporting a peripheral edge part of the inner surface of the crown plate, wherein the crown plate support has a width of not more than 5 mm, and the minimum distance between the upper edge of the club face and the crown plate in the back-and-forth direction of the head is not less than 10 mm.

According to another aspect of the present invention, a golf club head comprises: a hollow main body provided with an upper opening located in a crown portion of the head; and a crown plate fitted in the upper opening and having a specific gravity less than that of the main body, and the main body is provided around the upper opening with a crown plate support supporting a peripheral edge part of the inner surface of the crown plate, wherein the crown plate support has a width of not more than 5 mm, and the thickness of the crown plate is not more than 0.7 mm.

Therefore, the weight of the crown plate support is reduced because of the narrow width, and it becomes possible to lower the center of gravity of the head.

By setting the minimum distance of not less than 10 mm, the stress acting on the junction of the crown plate and main body at impact is reduced, and thereby the durability of the junction can be increased while the crown plate support width is reduced.

By reducing the crown plate thickness down to 0.7 mm or less, the weight is reduced and the crown plate becomes easy to deflect at impact. As a result, the stress acting on the junction at impact is reduced, and the durability of the junction can be improved.

In either case, it is possible to lower the center of gravity without decreasing the durability.

The above-mentioned width of the crown plate support is a width measured perpendicularly to a tangent to the edge of the opening.

The sweet spot SS is, as shown in FIG. 3, the point of intersection between the club face 2 and a straight line N drawn normally to the club face 2 passing the center of gravity G of the golf club head.

The back-and-forth direction of the club head is, as shown in FIG. 2, defined as being parallel to the direction γ of the straight line N extending between the sweet spot SS and the center of gravity G which is projected on a horizontal plane HP under the standard state of the head.

Here, the standard state is such that the head is put on the horizontal plane HP, maintaining its lie angle and loft angle.

If the upper edge 2*a* of the club face 2 is unclear due to smooth change in the curvature, a virtual edge line which is defined, based on the curvature change is used instead as follows. As shown in FIGS. 15 and 16, in each cutting plane P1, P2—including the sweet spot SS and the center of gravity G, a point 2*e* at which the radius (r) of curvature of the profile line Lf of the face portion first becomes under 200 mm in the course from the center SS to the periphery of the club face is determined. Then, the virtual edge line is defined as a locus of the points Pe.

DESCRIPTION OF THE PREFERRED EMBODIMENTS

Figure 1:
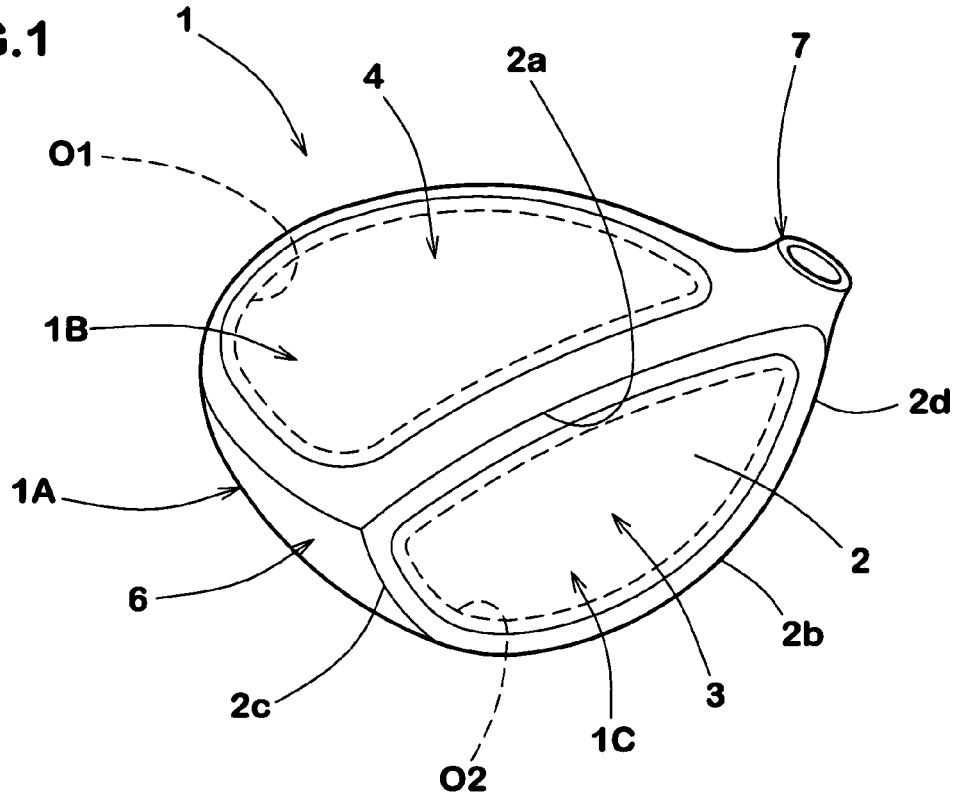
FIG. 1 is a perspective view of a wood-type golf club head according to the present invention.

Embodiments of the present invention will now be described in detail in conjunction with the accompanying drawings.

In the drawings, golf club head 1 according to the present invention is a wood-type hollow head which comprises a face portion 3 whose front face defines a club face 2 for striking a ball, a crown portion 4 intersecting the club face 2 at the upper edge 2*a* thereof, a sole portion 5 intersecting the club face 2 at the lower edge 2*b* thereof, a side portion 6 between the crown portion 4 and sole portion 5 which extends from a toe-side edge 2*c* to a heel-side edge 2*d* of the club face 2 through the back face BF of the club head, and a hosel portion 7 to be attached to an end of a club shaft (not shown).

In order to increase the moment of inertia of the club head 1 to minimize undesirable motions of the club head at a missed shot and thereby to improve the directional stability, the volume of the club head 1 is preferably set in a range of not less than 120 cc, more preferably not less than 150 cc. However, if the head volume is too large, there is a tendency that the golf swing balance becomes bad due to the increased club weight, decreased head speed or the like, and also the durability tends to deteriorate. Therefore, the head volume is preferably not more than 460 cc, more preferably not more than 450 cc, still more preferably not more than 400 cc.

Similarly, the weight of the club head 1 is preferably not less than 170 grams, more preferably not less than 180 grams, but preferably not more than 250 grams, more preferably not more than 230 grams.

The club head 1 in this embodiment has a three-piece structure composed of a face plate 1C forming a most part of the face portion 3, a crown plate 1B forming a most part of the crown portion 4, and a hollow main body 1A provided with an upper opening O1 and a front opening O2. The face plate 1C and crown plate 1B are fitted in the upper opening O1 and front opening O2, respectively, to close the openings and their inner surfaces face the hollow (i).

In this example, the upper opening O1 and the front opening O2 are formed within the crown portion 4 and the face portion 3, respectively, although it is possible that the upper opening O1 protrudes from the crown portion 4 and/or the front opening O2 protrudes from the face portion 3.

Thus, the main body 1A in this example is made up of: the sole portion 5; the side portion 6; the hosel portion 7; an annular peripheral part 10 of the crown portion 4 surrounding the upper opening O1; and an annular peripheral part 11 of the face portion 3 surrounding the front opening O2.

In order to lower the center of gravity and to increase the moment of inertia of the head, the hollow main body 1A is made of a metal material having the largest specific gravity ρ1. The specific gravity ρ1 is not less than 4.0, preferably not less than 5.0, more preferably not less than 7.0, but not more than 10.0, preferably not more than 9.0, more preferably not more than 8.0. Especially preferred are stainless alloys (specific gravity of about 7.8) and maraging steels (specific gravity of about 8.2) and the like.

The face plate 1C is made of a metal material having a specific gravity ρ3 smaller than the specific gravity ρ1 of the hollow main body 1A. This facilitates the increasing of the depth GL of the center of gravity G (namely, the distance in the back-and-forth direction of the head from the leading edge of the head to the center of gravity) and the above-mentioned gear effect becomes more liable to occur. Further, as a club head having a deep center of gravity has a large moment of inertia, the directional stability of the head can be improved.

In view of the durability, the face plate 1C has a thickness t4 of not less than 1.5 mm, preferably not less than 2.0 mm, but in view of weight reduction in the face portion 3, the thickness t4 is preferably not more than 4.0 mm, more preferably not more than 3.0 mm.

In this example, the thickness t4 is substantially constant all over the face plate 1C. But, it is also possible to have a variable thickness. For instance, it is preferable that a center part of the face plate including the sweet spot is increased in the thickness and the surrounding part is relatively decreased in the thickness to improve the durability and rebound performance of the face portion.

The crown plate 1B is made of a material having a specific gravity ρ2 smaller than the specific gravity ρ1 of the main body 1A in order to lower the center of gravity G.

In general, a metal material of which specific gravity is less than 0.5 has a tendency to possess an insufficient strength. Therefore, it is preferable that the above-mentioned specific gravity ρ2 and ρ3 is set in a range of not less than 0.5, more preferably not less than 1.0, still more preferably not less than 1.5, but not more than 6.0, more preferably not more than 5.0, still more preferably not more than 4.6 in order to achieve a weight reduction in the face portion and crown portion.

The specific gravity ratio (ρ1/ρ2) and/or the specific gravity ratio (ρ1/ρ3) are preferably set in a range of not less than 1.5, more preferably not less than 1.7, but not more than 8.0, more preferably not more than 7.0, still more preferably not more than 6.0.

Specifically, titanium alloys (specific gravity of about 4.5), aluminum alloys (specific gravity of about 2.7), magnesium alloys (specific gravity of about 1.8) and the like are preferably used as the materials for the face plate 1C and crown plate 1B.

Figure 2:
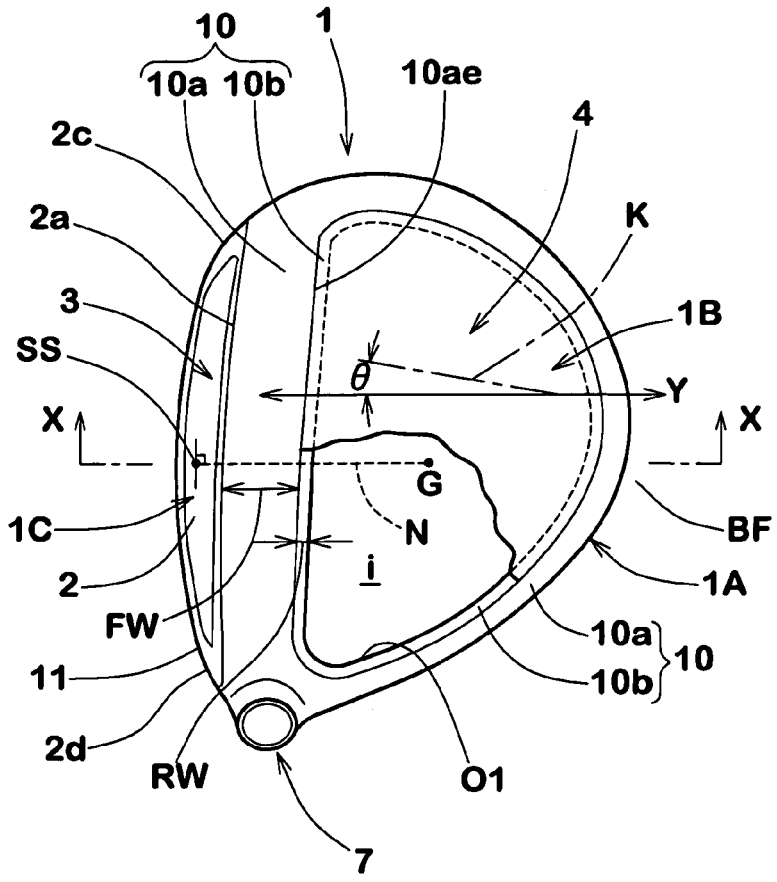
FIG. 2 is a top view thereof.
Figure 3:
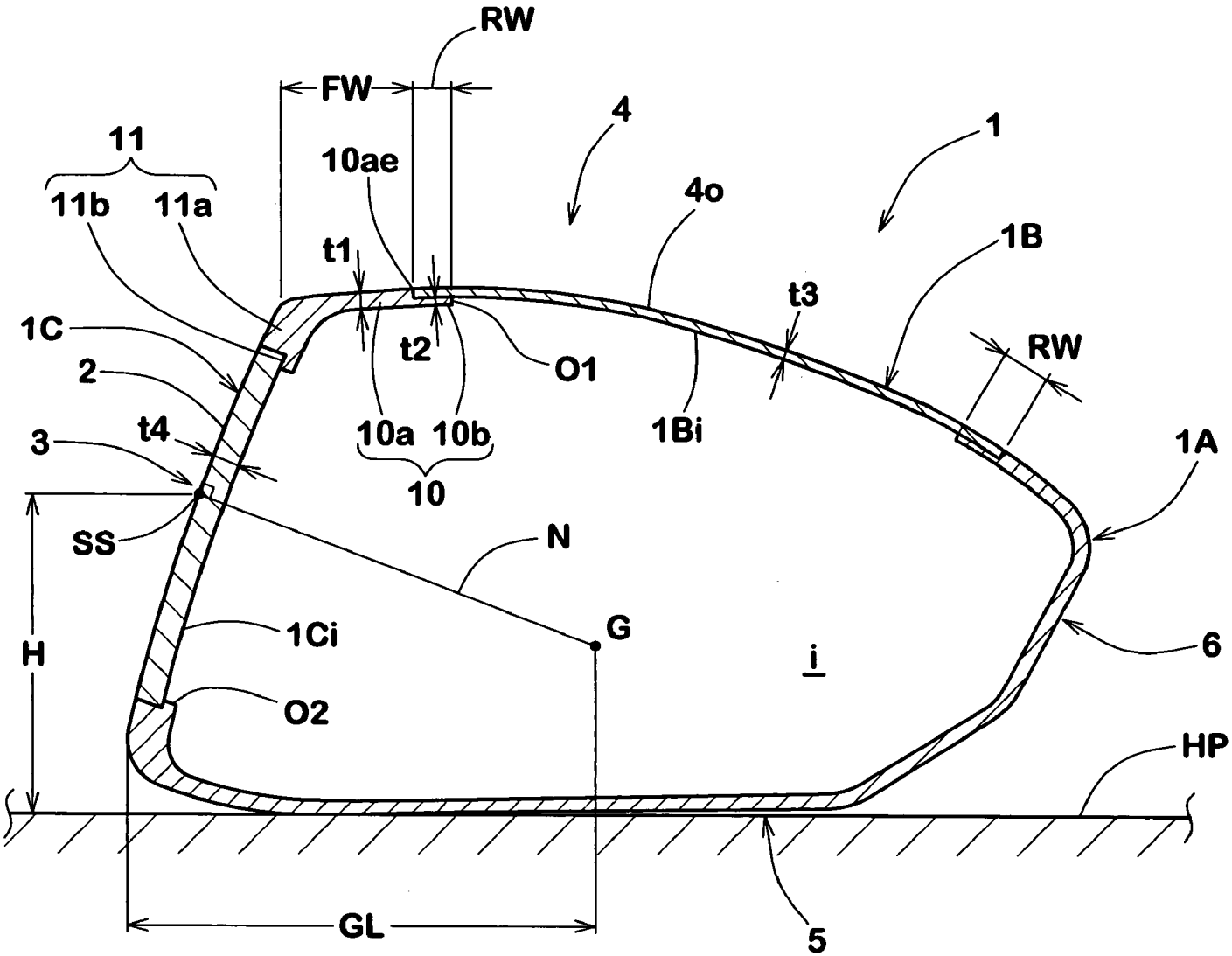
FIG. 3 is a cross sectional view taken along a line X-X of FIG. 2.

In the example shown in FIGS. 1-3, the upper opening O1 has a shape similar to but smaller than the shape of the crown portion 4 so that the above-mentioned annular peripheral part 10 has a substantially constant larger width along the front edge of the opening O1 as shown in FIG. 2. But, various shapes not similar to the shape of the crown portion 4 can be used as shown in FIGS. 4, 5 and 6.

Figure 4:
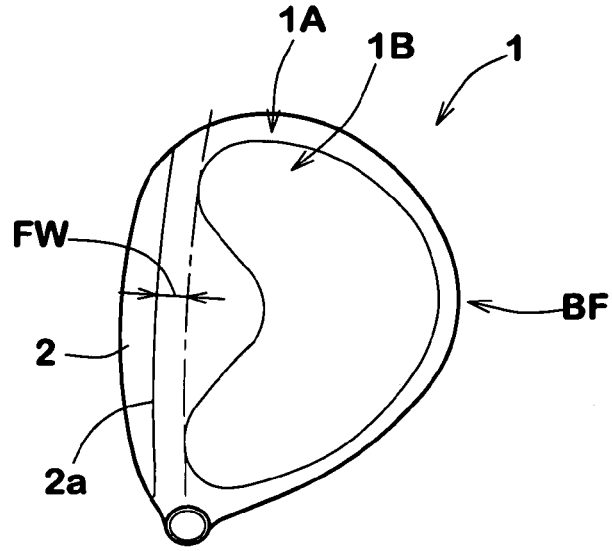
FIGS. 4, 5 and 6 are top views each showing another example of the upper opening.

In FIG. 4, the opening O1 is formed within the crown portion, and the shapes of the opening O1 and crown plate 1B are heart-shaped or v-shaped so that the width of a front part of the annular peripheral part 10 along the front edge of the opening O1 is gradually increased towards the center in the heel-and-toe direction of the head from the toe and heel. In this arrangement, the durability of the junction is most effectively improved because the distance FW from the face portion to the junction of the crown plate becomes maximum at the center of the club face at which the stress at impact is maximum.

Figure 5:
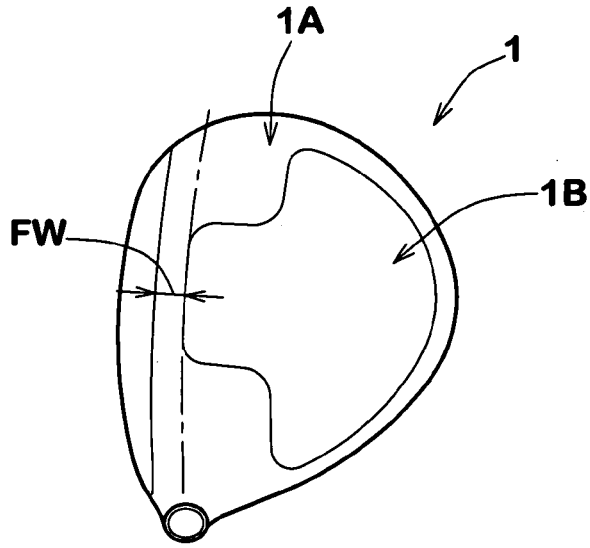

In FIG. 5, the opening O1 is formed within the crown portion, and the shapes of the opening O1 and crown plate 1B are arrow-shaped, pointing backward. In this example, the width of a front part of the annular peripheral part 10 along the front edge of the opening O1 is gradually increased from the center in the heel-and-toe direction towards the feel and toe. Thus, contrary to the FIG. 4 example, the distance FW is relatively increased on the heel side and toe side when compared with that in the center. Accordingly, in the front end zone of the crown portion, the weight is shifted towards the heel and toe occurs. Therefore, the moment of inertia of the head around a vertical axis passing the center of gravity of the head is increased, and the directional stability can be improved.

Figure 6:
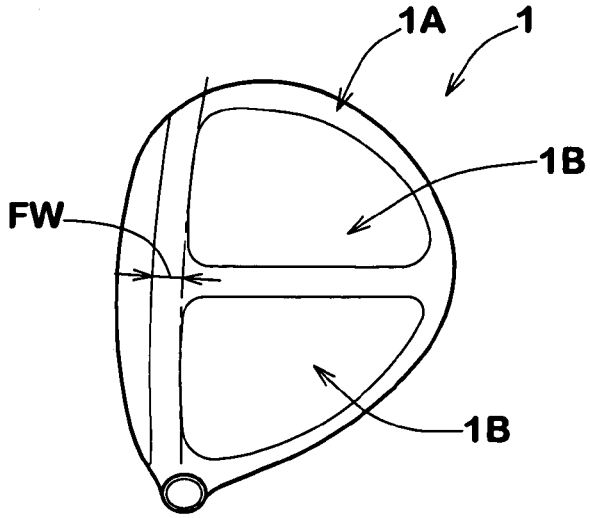

In FIG. 6, instead of the single large opening O1, a plurality of small openings O1 are formed within the crown portion. In this example, a large opening similar to that shown in FIG. 2 is divided into two small openings O1 by a bridge extending from the front edge to the rear edge of the large opening. Due to the bridge, the stress acting on the crown plate at impact is mitigated, and the durability can be improved.

In any case, in order to effectively lower the center of gravity of the head by using the light-weight crown plate 1B, the area of the upper opening O1 is preferably not less than 20 sq. cm, more preferably not less than 23 sq. cm, but, not more than 60 sq. cm, more preferably not more than 50 sq. cm to secure the necessary durability for the crown portion 4.

Here, the area of the upper opening O1 is the area projected on the horizontal plane HP under the standard state of the club head.

The main body 1A is provided around the upper opening O1 with a crown plate support 10*b* which contacts and supports the peripheral edge part of the inner surface 1Bi of the crown plate 1B.

Therefore, the shape of the crown plate 1B is similar to but a little larger than the shape of the upper opening O1 in order that the peripheral edge part of the crown plate 1B can overlap with the support 10*b*, and the opening can be completely closed.

The above-mentioned annular peripheral part 10 of the crown portion 4 accordingly includes: a main part 10*a* of which outer surface forms a part of the outer surface of the crown portion 4; and the crown plate support 10*b* of which outer surface is set back from the outer surface of the main part 10*a* so that the outer surface of the crown plate 1B becomes flush with the outer surface of the main part 10*a*.

It is preferable that the crown plate support 10*b* extends continuously around the opening O1, namely, it is annular. But, it is also possible to provide the crown plate support 10*b* made up of discontinuous parts so that the total length thereof measured along the edge of the opening O1 become not less than 50%, preferably not less than 60%, more preferably not less than 80% of the entire circumferential length of the opening O1 to prevent the joint strength from decreasing.

To provide durability for the crown portion 4, the thickness t1 of the main part 10*a* is not less than 0.3 mm, preferably not less than 0.4 mm, more preferably not less than 0.8 mm. But, to prevent undesirable weight increase in the crown portion, the thickness t1 is preferably limited to not more than 2.0 mm, more preferably not more than 1.5 mm.

The thickness t2 of the crown plate support 10*b* is not less than 0.2 mm, preferably not less than 0.3 mm, more preferably not less than 0.5 mm, to provide sufficient strength against impact, but in view of the weight reduction, the thickness t2 is preferably not more than the thickness t1 of the main part 10*a*.

On the other hand, the front opening O2 has a shape similar to but a little smaller than the shape of the face portion.

The main body 1A is provided around the front opening O2 with a face plate support 11*b* which contacts and supports the peripheral edge part of the inner surface 1Ci of the face plate 1C.

Therefore, the shape of the face plate 1C is similar to but a little larger than the shape of the front opening O2 in order that the peripheral edge part of the face plate 1C can overlap with the support 11*b*, and the opening can be completely closed.

The above-mentioned annular peripheral part 11 of the face portion 3 accordingly includes: a main part 11*a* of which outer surface forms a part of the outer surface of the face portion; and the face plate support 11*b* of which outer surface is set back from the outer surface of the main part 11*a* so that the outer surface of the face plate 1C becomes flush with the outer surface of the main part 11*a*.

The point of the present invention is to decrease the width RW of the crown plate support 10*b* as small as possible in order to reduce the weight.

However, if the width RW is too small, the strength of the junction of the main body 1A and crown plate 1B becomes insufficient. Therefore, the width RW must be at least 1.0 mm, preferably not less than 1.5 mm, more preferably not less than 2.0 mm. If the width RW is more than 5 mm, as the weight reduction in the crown portion becomes insufficient, it is difficult to lower the center of gravity. Therefore, the width RW is not more than 5 mm, preferably not more than 4.5 mm, more preferably not more than 4 mm.

The width RW can be a constant value along the edge of the opening. But, the width RW can be varied. For example, in order to further the weight reduction and improve the durability at the same time, the width RW is preferably increased in the face side part of the crown plate support 10*b* and decreased in the rear side part of the crown plate support 10*b*. Here, the face side part means a part on the front side of the center of gravity G of the head under the standard state, and the rear side part means a part on the rear side of the center of gravity G, when viewed from above.

In the case of the crown plate support having a narrow width, it is inevitable that the strength of the junction is decreased when compared with the wide support. Therefore, in order to decrease the stress acting on the junction of the crown plate and the support and thereby to maintain or improve the durability, at least one of the following designs (1) and (2) is employed to escape a stress concentration on the junction. (1) keep the junction as far away from the upper edge of the face portion, especially from the center portion of the upper edge as possible. (2) make the crown plate as thin as possible to have suppleness.

The minimum distance FW measured in the back-and-forth direction of the head from the upper edge 2*a* of the club face 2 to the front edge of the crown plate 1B, namely, to the junction is absolutely not less than 3 mm, preferably not less than 4 mm in order that the annular peripheral part 10 is provided with a sufficient strength and durability.

As to the thickness t3 of the crown plate 1B, on the other hand, if the thickness t3 is too small, it is difficult to provide the necessary durability, strength and the like. Therefore, the thickness t3 is not less than 0.3 mm, preferably not less than 0.4 mm.

When the thickness t3 of the crown plate 1B is sufficiently decreased to 0.7 mm or less, from the point of view of the weight reduction in the crown portion, it is preferable that the minimum distance FW is set in a range of not more than 8 mm, more preferably not more than 7 mm, still more preferably not more than 6 mm because the wide opening O1 can be obtained.

If the thickness t3 is not sufficiently decreased, the minimum distance FW is set in a range of not less than 10 mm, thereby the stress acting on the junction at impact can be reduced to improve the durability. Nevertheless, the thickness t3 is preferably not more than 2.0 mm, more preferably not more than 1.5, mm because the weight reduction in the crown portion 4 is hindered if the thickness t3 is too large.

Especially, the club head 1 having the minimum distance FW of not less than 10 mm and the crown plate thickness t3 of not more than 0.7 mm, ensures the lowering of the center of gravity G and the prevention of a decrease in the durability.

In either case, in order to increase the rigidity of the crown portion 4 as a whole, it is preferable that the ratio (t1/t3) of the thickness t1 of the main part 10*a* to the thickness t3 of the crown plate 1B is not less than 1.0, preferably not less than 1.5, more preferably not less than 2.0, but not more than 4.0, preferably not more than 3.0.

The crown plate 1B can be formed by casting or forging a metal material. But, in such a case, as the crown plate 1B is unusually thin, structural defects or uneven residual stress distribution inherent in such processes tends to deteriorate the durability of the plate. Therefore, the use of a rolled metal material gradually extended into the predetermined uniform thickness is preferred because the structural defects and uneven residual stress distribution are minimized.

In this embodiment, therefore, the crown plate 1B is manufactured from a rolled metal plate. For instance, a titanium alloy Ti-6Al-4V is used.

Figure 7:
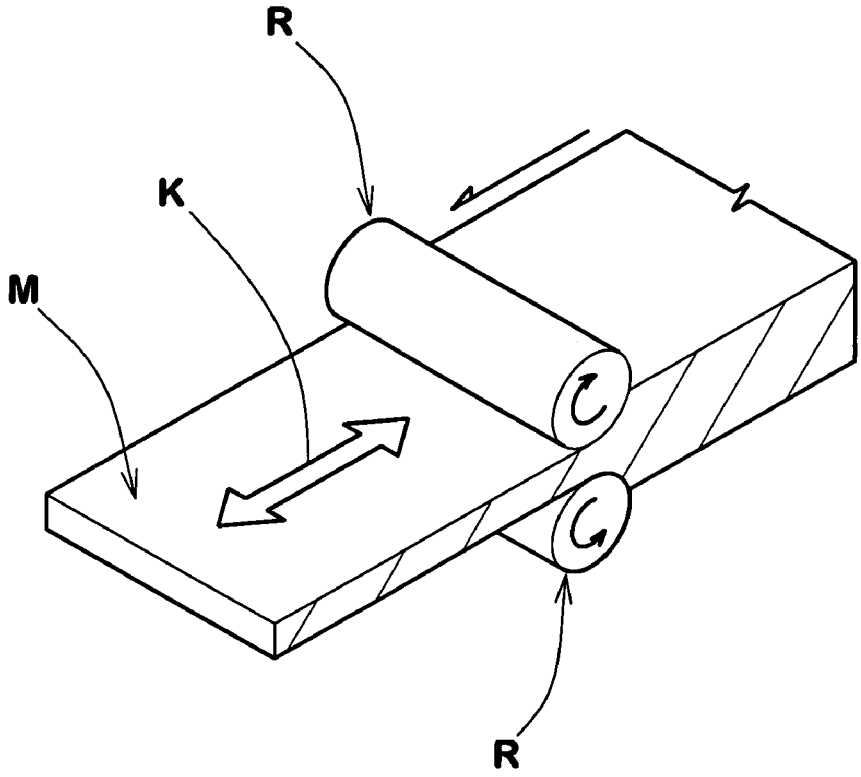
FIGS. 7, 8, 9 and 10 are schematic views for explaining a method of manufacturing the crown plate.

As shown in FIG. 7, the metal material M for the crown plate is extended in a direction K, while passing through between rollers R. Usually, the material is extended a plurality of times, and there is a possibility that the extending direction is changed at each time, therefore, the extended direction K at the last time is treated as the extended direction of the material. Before subjected to the rolling process, the metal material may be subjected to a casting process, forging process, grinding process and the like. After the rolling process, the rolled metal plate may be subjected to a press bending process, punching process, cutting process and the like. Further, such processed plate may be subjected to a heat treatment process. Thus, due to the work hardening, the mechanical characteristics are improved, and a homogeneous crystal structure having less defect can be obtained.

Figure 8:
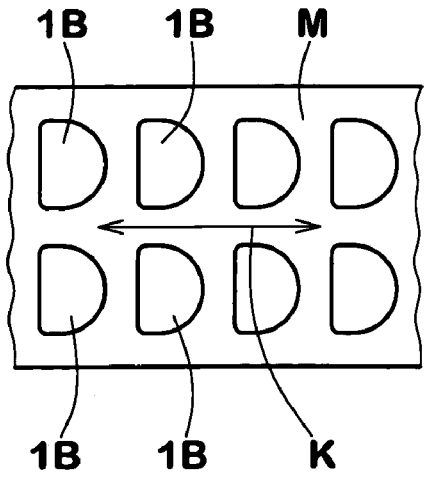

Next, as shown in FIG. 8, from the rolled metal plate M, the crown plate is punched out, aligning the extended direction K with the back-and-forth direction of the head for the undermentioned reason.

Figure 9:
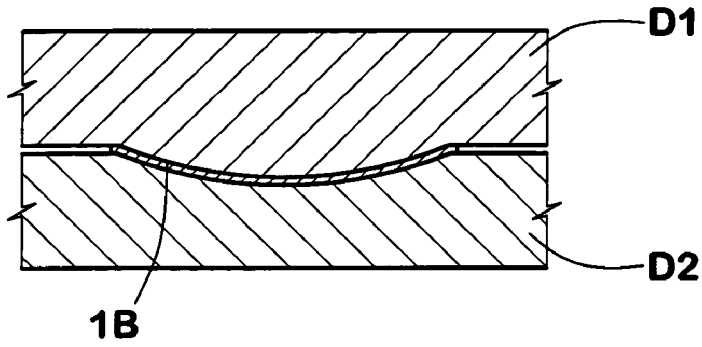
Figure 10:
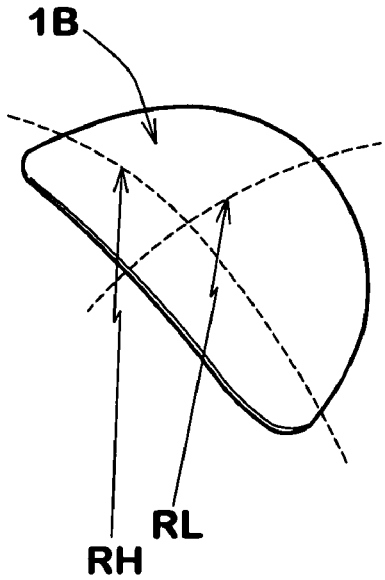

Then, as shown in FIG. 9, by pressing between the dies D1 and D2, the crown plate is shaped to have a curvature. The curvature has, as shown in FIG. 10, a radius RL in a vertical plane parallel to the back-and-forth direction of the head and a radius RH in a vertical plane parallel to the toe-and-heel direction.

Finally, edge trimming is made as needed.

As to the alignment of the extended direction K, as the result of experiments carried out by the present inventor, it was discovered that, by aligning the extended direction K of the crown plate 1B with the back-and-forth direction γ of the head, the crown plate 1B becomes easy to deflect outward at impact. The "outward" means such a deflection that the radius of curvature RL becomes smaller. Such outward deflection will reduce the stress acting on the junction and allows to increase the loft angle at impact to improve the shot angle. Therefore, it is preferable that the angle θ between the extended direction K and the back-and-forth direction γ is set in a range of not more than 20 degrees, more preferably not more than 10 degrees, still more preferably not more than 5 degrees, most preferably 0 degree.

The hollow main body 1A in this example is manufactured by casting the above-mentioned material. But, it is also possible to manufacture the main body 1A by assembling two or more parts which are prepared through appropriate methods such as forging, rolling and bending.

The crown plate 1B is attached to the hollow main body 1A.

In order to fix the peripheral edge portion of the crown plate 1B to the support 10*b*, various methods, e.g. heat welding, pressure welding, soldering, adhesive joining, caulking and the like can be employed alone or in combination. If there is a micro-gap between the edge 1Be of the crown plate 1B and the edge 10*ae* of the main part 10*a*, the gap is filled with an adhesive agent or a weld metal.

Figure 11:
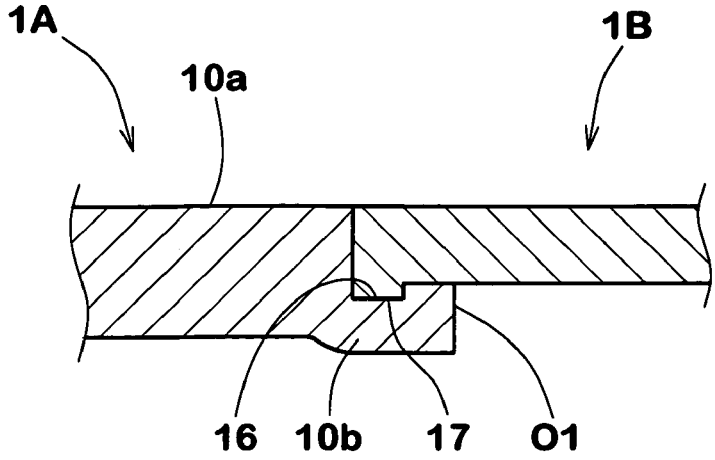
FIGS. 11, 12 and 13 are enlarged cross sectional views each showing another example of the junction of the crown plate and the support.

To aid the fixation by preventing the crown plate 1B from slipping off the support 10*b*, as shown in FIG. 11, the crown plate 1B and support 10*b* can be provided with a protrusion 17 and a groove 16, respectively, or vice versa so as to engage with each other.

Figure 12:
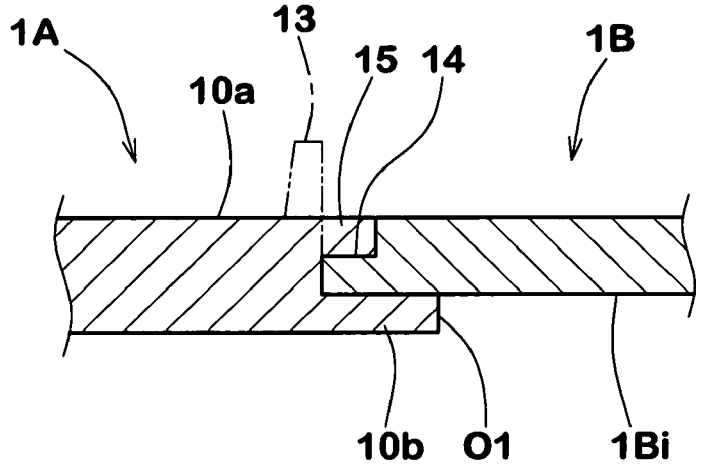
Figure 13:
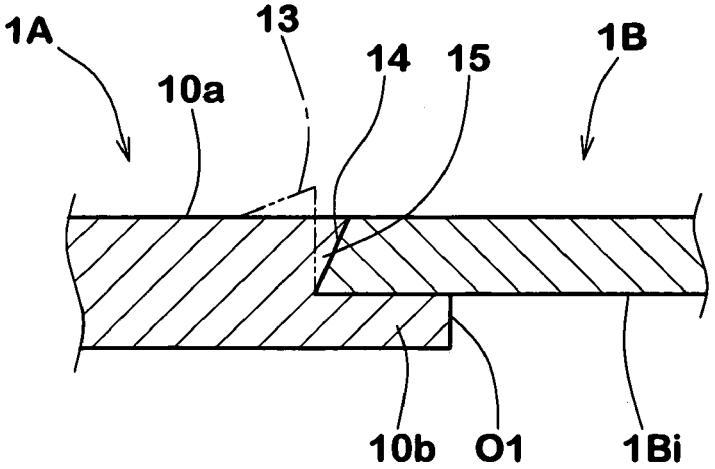

Since the crown plate 1B and support 10*b* are very thin, the simultaneous use of an adhesive agent and the caulking shown in FIG. 12 or FIG. 13 is preferred.

In FIGS. 12 and 13, the hollow main body 1A is provided with a crushable protrusion 13, and the crown plate 1B is provided with a dent 14.

Figure 14:
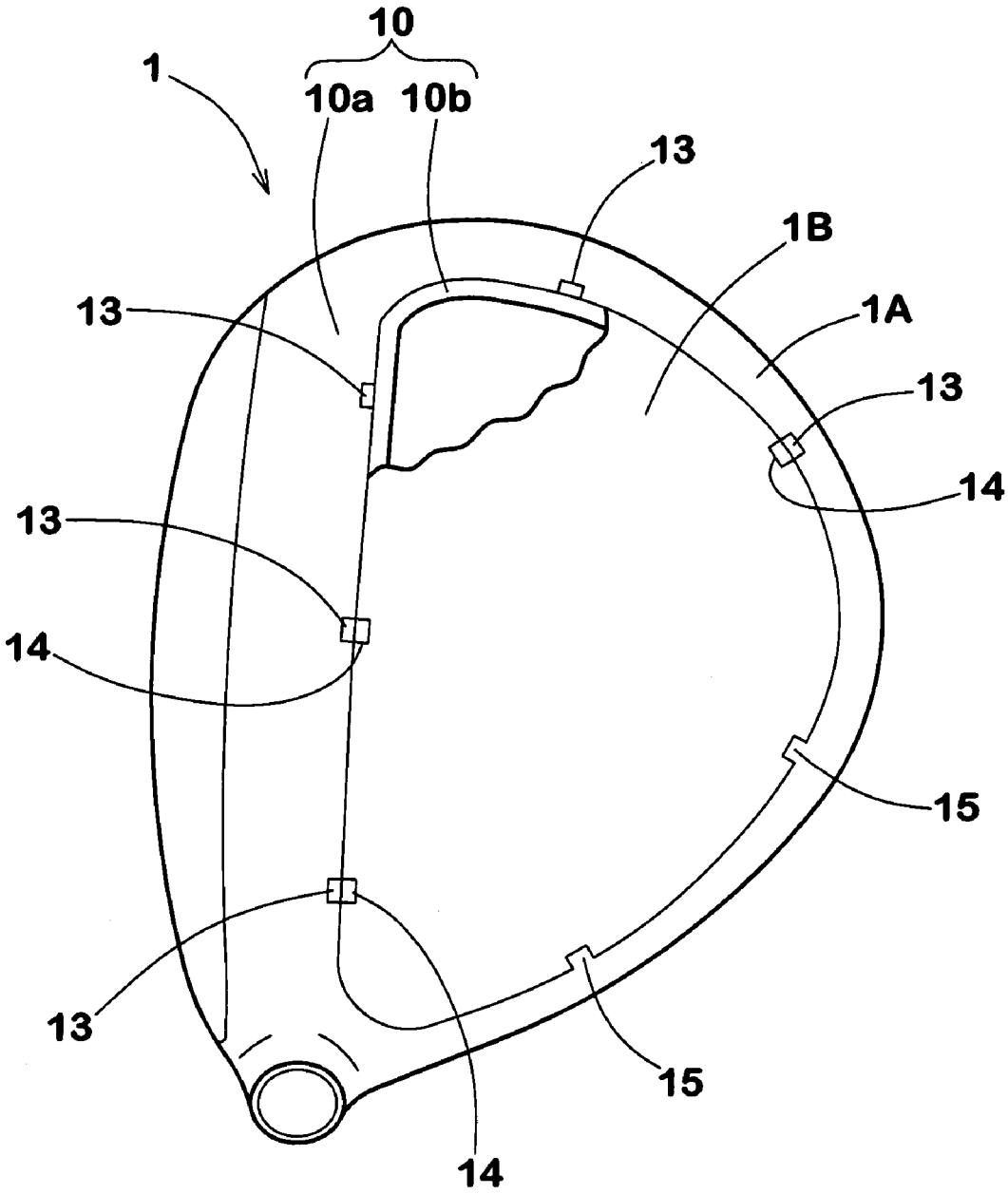
FIG. 14 is a top view showing an arrangement of protrusions and dents.
Figure 15:
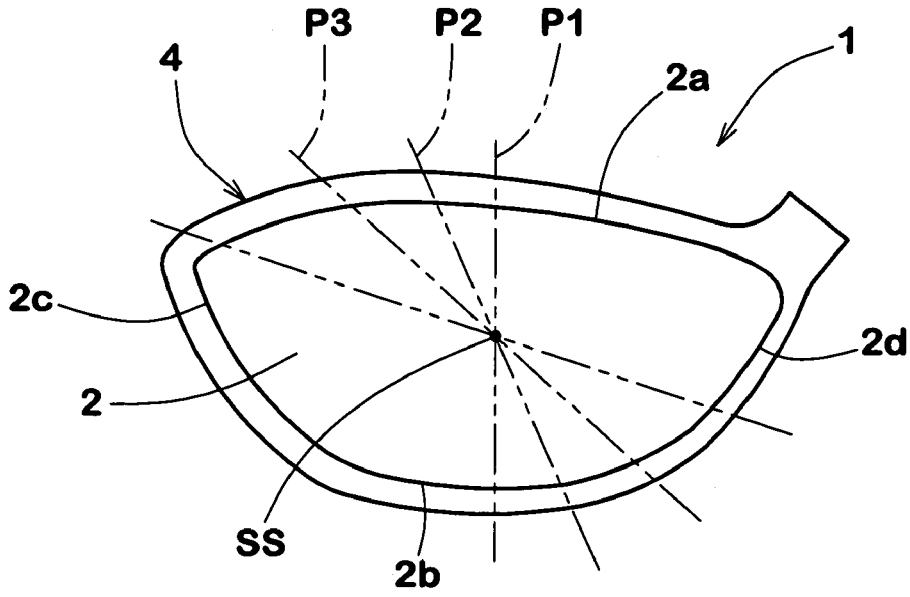
FIGS. 15 and 16 are diagrams for explaining the edge of the face portion.
Figure 16:
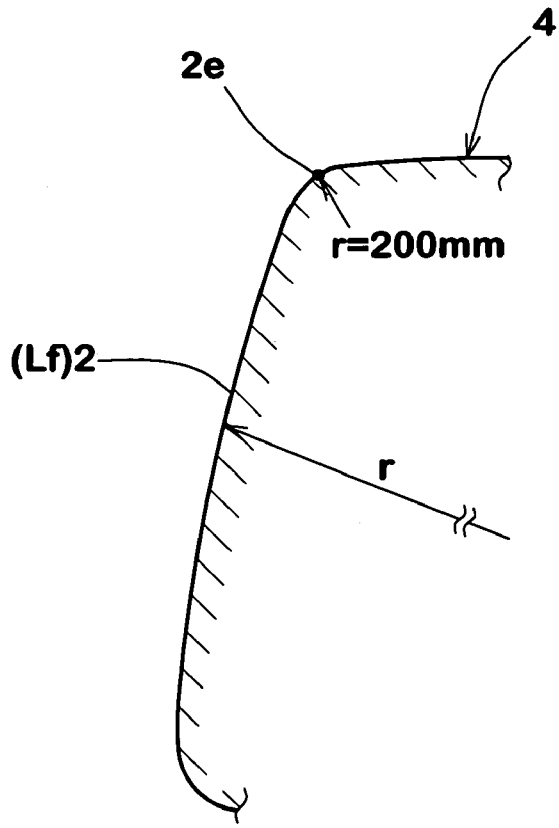
Figure 17:
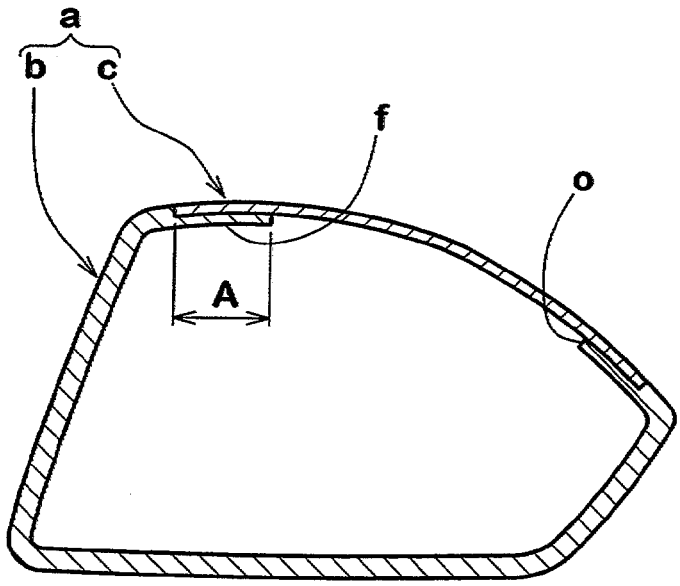
FIG.17 PRIOR ART
FIG. 17 is a cross sectional view of the prior-art golf club head.

In the example shown in FIG. 14, a plurality of protrusions 13 are arranged along the edge 10*ae* of the main part 10*a* at intervals. Also a plurality of dents 14 are arranged at intervals along the edge 1Be of the crown plate 1B at the corresponding positions to the protrusions 13. The protrusions 13 and dents 14 are about 2 mm to about 4 mm when measured along the edges 10*ae*, 1Be.

To unite with the hollow main body 1A, the crown plate 1B is put on the crown plate support 10*b* after an adhesive agent is applied along the interface, and then, the protrusions 13 are plastic deformed so that the protrusions 13 crush in the dents 14 and they are accordingly engaged with each other. Therefore, the edge of the crown plate 1B is interlocked between the crushed protrusions 15 and the crown plate support 10*b*.

In FIG. 12, the dent 14 has: an outer face substantially parallel with the outer surface of the crown portion; and a side face substantially perpendicular to the outer face, thus the contour thereof is L-shaped.

In FIG. 13 showing another example of the dent 14, wherein the contour is straight and inclined towards the center of the crown plate.

In either case, the protrusion 13 may have various shapes or contours as far as it is crushable into the dent to fill the dent 14, and preferably the crushed protrusion 15 does not protrude from the outer surface of the crown portion to a large extent. In case of FIG. 12, The protrusion 13 has a trapezoidal cross-sectional shape. In case of FIG. 13, The protrusion 13 has a triangular cross-sectional shape.

Aside from the FIG. 14 example in which a plurality of relatively small protrusions 13 and dents 14 are disposed, it is also possible to form the protrusion 13 and dent 14 as being continuous along the edges 10*ae* and 1Be or as being longer than about 4 mm.

The face plate 1C is also attached to the hollow main body 1A.

In order to fix the peripheral edge portion of the face plate 1C to the support 11*b*, various methods, e.g. heat welding, soldering, adhesive joining, caulking and the like can be employed alone or in combination similarly to the crown plate.

Comparison Tests

Hollow metal wood club heads were made and tested for the durability and carry and measured for the sweet spot height. All the heads had the same structure except for the crown portion as shown in Table 1.

Carry Test:

The club heads were attached to identical FRP shafts (MP300, flex R, manufactured by SRI Sports Limited) and 45-inch wood clubs were made. Each club was attached to a swing robot (SHOT ROBO, manufactured by Miyamae Co., Ltd), and golf balls were hit five times per a head at the club face center at the head speed of 40 m/sec to obtain the average carry. The results are indicated in Table 1.

Durability Test:

Using the above-mentioned swing robot and wood clubs, each head hit golf balls 9000 times (max.) at the head speed of 50 m/sec, while checking the junction of the crown plate and main body every 100 times. If some kind of damage was found, the hitting was stopped and the number of total hits was recorded. The results are shown in Table 1. If there is no damage after 3000 hits, such a head is considered as having sufficient durability in practice.

Sweet Spot Height:

As shown in FIG. 3, under the standard state of the head, the height H of the sweet spot SS was measured as a vertical distance from the horizontal plane HP.

TABLE 1

| | Head | | | | | | | | | |
|---|---|---|---|---|---|---|---|---|---|---|
| | Ref. 1 | Ref. 2 | Ex. 1 | Ex. 2 | Ex. 3 | Ex. 4 | Ex. 5 | Ex. 6 | Ex. 7 | Ex. 8 |
| Crown plate support 10b | | | | | | | | | | |
| Width RW (mm) | 10 | 5 | 5 | 5 | 5 | 3 | 5 | 5 | 5 | 5 |
| Distance FW (mm) | 5 | 5 | 10 | 10 | 10 | 10 | 8 | 10 | 10 | 10 |
| Crown plate | | | | | | | | | | |
| Thickness ts (mm) | 1.0 | 1.0 | 1.0 | 0.7 | 0.5 | 0.7 | 0.7 | 1.0 | 1.0 | 1.0 |
| angle θ (deg) | 0 | 0 | 0 | 0 | 0 | 0 | 0 | 5 | 10 | 20 |
| Sweet spot height H (mm) | 35.0 | 32.0 | 33.0 | 30.0 | 29.0 | 32.5 | 28.5 | 33.0 | 33.0 | 33.0 |
| Carry (yard) | 220 | 230 | 225 | 240 | 243 | 228 | 245 | 224 | 223 | 221 |
| Durability | no damage | 2500 | 6000 | 8000 | 7800 | 7000 | 7500 | 6000 | 6000 | 6000 |

Common Data
Head volume: 300 cc
Loft angle: 10 degrees
Lie angle: 57 degrees
Hollow main body: Casting of SUS630 (Specific gravity 7.8)
Area of upper opening: 20 sq. cm
Thickness t1: 1.0 mm
Crown plate: Rolled plate of Ti—6Al—4V (specific gravity 4.5)
Face plate: Rolled plate of Ti—6Al—4V (specific gravity 4.5)
Face plate thickness t4: 3.0 mm
Weight of club head Ex. 1: 200 grams From the test results, it was confirmed that the center of gravity of the head can be lowered, without deteriorating the durability.

The present invention is suitably applied to a wood-type hollow head such as a driver (#1) and fairway wood. But, it can be also applied to iron-type, utility-type and patter-type golf club heads.

The invention claimed is:

1. A golf club head comprising:

a hollow main body provided with an upper opening located in a crown portion of the head, and a crown plate fitted in the upper opening and having a specific gravity less than that of the main body, the main body provided around the upper opening with a crown plate support supporting a peripheral edge part of the inner surface of the crown plate, wherein the crown plate support has a width of not more than 5 mm, and the minimum distance between the upper edge of the club face and the crown plate in the back-and-forth direction of the head is not less than 10 mm, wherein the upper opening is provided within the crown portion so as to form an annular peripheral part of the crown portion, the shapes of the upper opening and crown plate are heart-shaped or V-shaped, and the width of a front part of said annular peripheral part defined as extending along a front edge of the upper opening is gradually increased towards its center in the heel-and-toe direction of the head from the toe and heel of the head.

2. The golf club head according to claim 1, wherein the crown plate is made of a metal material having a thickness of not more than 0.7 mm.

3. The golf club head according to claim 1, wherein the crown plate is a rolled metal material.

4. The golf club head according to claim 1, wherein the crown plate is a rolled metal material extended in a certain direction, and the angle between the extended direction and the back-and-forth direction of the head is not more than 20 degrees.

5. The golf club head according to claim 1, wherein the hollow main body is provided with a front opening in a face portion of the head, and a face plate having a specific gravity less than that of the hollow main body is fitted in the front opening.

6. The golf club head according to claim 1, wherein a protrusion and a groove engaging with each other are provided on the outer surface of the crown plate support and the inner surface of the crown plate, whereby the crown plate is prevent from slipping off the crown plate support.

7. The golf club head according to claim 1, wherein the edge of the crown plate is locked between the crown plate support and a protrusion which is provided on a peripheral part of the crown portion around the opening and thrust into the crown plate support.

8. A golf club head which comprises:

a hollow main body provided with an upper opening located in a crown portion of the head, and a crown plate fitted in the upper opening and having a specific gravity less than that of the main body, the main body provided around the upper opening with a crown plate support supporting a peripheral edge part of the inner surface of the crown plate, wherein the crown plate support has a width of not more than 5 mm, and the thickness of the crown plate is not more than 0.7 mm, wherein the upper opening is provided within the crown portion so as to form an annular peripheral part of the crown portion, the shapes of the upper opening and crown plate are heart-shaped or V-shaped, and the width of a front part of said annular peripheral part defined as extending along a front edge of the upper opening is gradually increased towards its center in the heel-and-toe direction of the head from the toe and heel of the head.

9. The golf club head according to claim 8, wherein the crown plate is made of a metal material having a thickness of not more than 0.7 mm.

10. The golf club head according to claim 8, wherein the crown plate is a rolled metal material.

11. The golf club head according to claim 8, wherein the crown plate is a rolled metal material extended in a certain direction, and the angle between the extended direction and the back-and-forth direction of the head is not more than 20 degrees.

12. The golf club head according to claim 8, wherein the hollow main body is provided with a front opening in a face portion of the head, and a face plate having a specific gravity less than that of the hollow main body is fitted in the front opening.

13. The golf club head according to claim 8, wherein a protrusion and a groove engaging with each other are provided on the outer surface of the crown plate support and the inner surface of the crown plate, whereby the crown plate is prevent from slipping off the crown plate support.

14. The golf club head according to claim 8, wherein the edge of the crown plate is locked between the crown plate support and a protrusion which is provided on a peripheral part of the crown portion around the opening and thrust into the crown plate support.

15. A golf club head comprising:

a hollow main body provided with an upper opening located in a crown portion of the head, and a crown plate fitted in the upper opening and having a specific gravity less than that of the main body, the main body provided around the upper opening with a crown plate support supporting a peripheral edge part of the inner surface of the crown plate, wherein the crown plate support has a width of not more than 5 mm, the minimum distance between the upper edge of the club face and the crown plate in the back-and-forth direction of the head is not less than 10 mm, and the thickness of the crown plate is not more than 0.7 mm, wherein the upper opening is provided within the crown portion so as to form an annular peripheral part of the crown portion, the shapes of the upper opening and crown plate are heart-shaped or V-shaped, and the width of a front part of said annular peripheral part defined as extending along a front edge of the upper opening is gradually increased towards its center in the heel-and-toe direction of the head from the toe and heel of the head.

16. The golf club head according to claim 15, wherein the crown plate is made of a metal material having a thickness of not more than 0.7 mm.

17. The golf club head according to claim 15, wherein the crown plate is a rolled metal material.

18. The golf club head according to claim 15, wherein the crown plate is a rolled metal material extended in a certain direction, and the angle between the extended direction and the back-and-forth direction of the head is not more than 20 degrees.

19. The golf club head according to claim 15, wherein the hollow main body is provided with a front opening in a face portion of the head, and a face plate having a specific gravity less than that of the hollow main body is fitted in the front opening.

20. The golf club head according to claim 15, wherein a protrusion and a groove engaging with each other are provided on the outer surface of the crown plate support and the inner surface of the crown plate, whereby the crown plate is prevent from slipping off the crown plate support.

21. A golf club head comprising:

a hollow main body provided with an upper opening located in a crown portion of the head, and a crown plate fitted in the upper opening and having a specific gravity less than that of the main body, the main body provided around the upper opening with a crown plate support supporting a peripheral edge part of the inner surface of the crown plate, wherein the crown plate support has a width of not more than 5 mm, and the minimum distance between the upper edge of the club face and the crown plate in the back-and-forth direction of the head is not less than 10 mm, wherein the upper opening is provided within the crown portion so as to form an annular peripheral part of the crown portion, the shapes of the upper opening and crown plate are arrow-shaped, pointing backward of the head, and the width of a front part of said annular peripheral part defined as extending along a front edge of the upper opening is increased as a step from its center in the heel-and-toe direction of the head towards the toe and heel of the head so that the front part has a substantially constant smaller width in said center and a substantially constant larger width on the toe side and heel side of said center.

* * * * *